US012108796B2

(12) United States Patent
Rogan et al.

(10) Patent No.: US 12,108,796 B2
(45) **Date of Patent: *Oct. 8, 2024**

(54) AEROSOL GENERATING DEVICE WITH A LASER

(71) Applicant: JT International SA, Geneva (CH)

(72) Inventors: Andrew Robert John Rogan, Forres (GB); Roland Stalder, Zürich (CH)

(73) Assignee: JT International S.A. (CH)

( * ) Notice: Subject to any disclaimer, the term of this patent is extended or adjusted under 35 U.S.C. 154(b) by 45 days.

This patent is subject to a terminal disclaimer.

(21) Appl. No.: 17/838,762

(22) Filed: Jun. 13, 2022

(65) Prior Publication Data

US 2022/0295891 A1 Sep. 22, 2022

Related U.S. Application Data

(63) Continuation of application No. 16/092,606, filed as application No. PCT/EP2017/059359 on Apr. 20, 2017, now Pat. No. 11,357,261.

(30) Foreign Application Priority Data

Apr. 22, 2016 (EP) ..... 16166608

(51) Int. Cl.

| | |
|---|---|
| ***A24F 40/46*** | (2020.01) |
| ***A24F 40/10*** | (2020.01) |
| ***A24F 40/42*** | (2020.01) |
| ***A24F 40/44*** | (2020.01) |
| *A24B 15/16* | (2020.01) |
| *A24F 40/20* | (2020.01) |
| *A24F 40/30* | (2020.01) |
| *A24F 40/50* | (2020.01) |

(52) U.S. Cl.
CPC ..... *A24F 40/46* (2020.01); *A24F 40/42* (2020.01); *A24F 40/44* (2020.01); *A24B 15/16* (2013.01); *A24F 40/10* (2020.01); *A24F 40/20* (2020.01); *A24F 40/30* (2020.01); *A24F 40/50* (2020.01)

(58) Field of Classification Search
CPC ..... A24F 40/10; A24F 40/46
See application file for complete search history.

(56) References Cited

U.S. PATENT DOCUMENTS

| | | | |
|---|---|---|---|
| 5,989,246 | A | 11/1999 | Kaufmann et al. |
| 7,065,270 | B2 | 6/2006 | Okada et al. |

(Continued)

FOREIGN PATENT DOCUMENTS

| | | | |
|---|---|---|---|
| CN | 203646497 | U | 6/2014 |
| CN | 104522892 | A | 4/2015 |
| CN | 104643290 | A | 5/2015 |

OTHER PUBLICATIONS

International Search Report including Written Opinion for PCT/EP2017/059359 (published as WO2017182554) mailed Jul. 31, 2017.

*Primary Examiner* — Russell E Sparks
(74) *Attorney, Agent, or Firm* — Lerner David LLP

(57) ABSTRACT

An aerosol generating device includes a target; a laser emitter configured to emit light and vaporise a vaporisable material at the target in use; and an optional light guide for guiding light emitted from the laser emitter to the target. An aerosol generating system includes the aerosol generating device and an outer shell for receiving the aerosol generating device in use.

10 Claims, 6 Drawing Sheets

(56) References Cited

U.S. PATENT DOCUMENTS

| | | | | |
|---|---|---|---|---|
| 7,726,320 | B2 * | 6/2010 | Robinson | A24F 40/40 131/194 |
| 9,888,719 | B2 | 2/2018 | Cadieux et al. | |
| 10,206,429 | B2 * | 2/2019 | Davis | A61M 15/06 |
| 10,617,150 | B2 | 4/2020 | Cameron | |
| 10,667,556 | B2 | 6/2020 | Schneider | |
| 11,357,261 | B2 * | 6/2022 | Rogan | A24F 40/42 |
| 2012/0260926 | A1 | 10/2012 | Tu et al. | |
| 2015/0114409 | A1 | 4/2015 | Brammer et al. | |
| 2015/0328415 | A1 | 11/2015 | Minskoff et al. | |
| 2015/0351456 | A1 | 12/2015 | Johnson et al. | |
| 2016/0150828 | A1 * | 6/2016 | Goldstein | H05B 6/36 392/387 |
| 2016/0338407 | A1 | 11/2016 | Kerdemelidis | |
| 2017/0281256 | A1 | 10/2017 | Slatkine et al. | |

* cited by examiner

AEROSOL GENERATING DEVICE WITH A LASER

CROSS-REFERENCE TO RELATED APPLICATIONS

The present application is a continuation of U.S. patent application Ser. No. 16/092,606, filed on Oct. 10, 2018, which is a national phase entry under 35 U.S.C. § 371 of International Application No. PCT/EP2017/059359, filed Apr. 20, 2017, published in English, which claims priority to European Application No. 16166608.6 filed Apr. 22, 2016, the disclosures of which are incorporated herein by reference.

BACKGROUND OF THE INVENTION

The present invention relates to an aerosol generating device having a laser light source for vaporising a liquid, gel or solid.

Aerosol generating systems such as electronic cigarettes are becoming increasingly popular amongst users. The operating principle for these electronic cigarettes usually centres around providing a flavoured aerosol to a user without burning material. Some known devices comprise a capillary wick and a coil heater, which can be activated by the user for example through suction on a mouthpiece of the device, or by activating a push button on the device. This switches on a battery power supply that activates the heater, which vaporises a liquid, gel or solid material. Suction on the mouthpiece further causes air to be drawn into the device through one or more air inlets and towards the mouthpiece via the capillary wick, and the vapour that is produced near the capillary wick mixes with air from the air inlet and is conveyed towards the mouthpiece as an aerosol.

One particular challenge that is often faced in the design of such aerosol generating systems is how to heat the material effectively without burning. In prior art systems, heaters have been known to comprise any one of a ceramic, a coil-of-wire, inductive heating means, ultrasonic heating means and/or piezoelectric heating means. In particular, a coil-of-wire heater and wick arrangement has been found to deliver adequate means for heating material without burning. However, the coil-of-wire heater may take some time to heat up and so the heating provided as a result may not always be easy to control by the user.

BRIEF SUMMARY OF THE INVENTION

The present invention seeks to provide an aerosol generating system which overcomes the above mentioned problems including providing improved means for heating material without burning.

The present inventors have recognised that a greater degree of flexibility and control is required in the heating process in order to enhance the smoking experience of an aerosol generating system such as an electronic cigarette.

Accordingly, viewed from one aspect of the present invention, there is provided an aerosol generating device, the device comprising: a target; and a laser emitter configured to emit light to vaporise a vaporisable material at the target in use. The aerosol generating device may be configured to ultimately provide the aerosol through a mouthpiece to a user. Said aerosol generating device may be particularly suited for use in an aerosol generating system such as an e-cigarette. Preferably the device further comprises a light guide for guiding light emitted from the laser emitter to the target A laser emitter may be understood as any device that emits laser light. A laser emitter differs from other sources of light in that it emits light coherently, which light is generally in phase and of the same or similar wavelength. The use of a laser emitter, which may be a laser diode of the semiconductor type, as the means for heating the material to be vaporised provides an advantage over conventional heating means, such as the coil-of-wire heater, in that it is much easier for a user to control the amount of heat that is provided to the material.

The laser emitter may preferably emit light in a wavelength spectrum matching the absorption peak of a surface material of the target, and this wavelength spectrum is preferably the infrared (IR) spectrum. As an example, this range of wavelengths could be between 375 to 3500 nanometres, more preferably 700 to 1000 nanometres (in the IR range), yet more preferably about 785 nanometres.

The aerosol generating device preferably utilises a light guide for guiding light emitted from the laser emitter to the point at which liquid is to be vaporised at the target. A light guide may be defined as a waveguide device that transports light from a light source (the laser emitter in the present invention) to a point some distance away with minimal loss, for example, by means of total internal reflection. Light guides are usually made of optical grade materials such as acrylic resin, polycarbonate, epoxies, and glass, and in the context of the present invention, the light guide may be shaped as a light guide bar.

The light guide is preferably a discrete component from the laser emitter and/or from the target. The light guide may preferably be arranged in the aerosol generating device at an intermediate position between the target and the laser emitter.

By way of comparison, a lens may be defined as an optical device for focusing or dispersing light by means of refraction. The aerosol generating device may further comprise a lens disposed between the laser emitter and the light guide, which acts to provide focusing means of light that has been emitted by the laser emitter and transported along the light guide towards the target. Together, the light guide and lens form an assembly that acts to direct and focus light from the laser emitter to the target in a manner that can be very accurately designed and implemented.

As used herein, the term "vaporisable" has its usual meaning in the art, referring to a material that is capable of being converted to from a solid, gel or liquid state to a gaseous state upon heating. The vaporisable material may therefore be one or more of a liquid, a solid and a gel. The terms "aerosol-forming material" and "vaporisable material" may be used interchangeably herein.

The liquid material may comprise tobacco or flavourants comprising tobacco. In addition or alternatively, the liquid material may comprise flavourants not comprising tobacco. The liquid to be vapourised may also comprise propylene glycol, glycerine or glycol derivatives and mixtures thereof.

In the case where the vaporisable material is a gel, said gel may comprise Nicogel (a nicotine gel). In the case where the vaporisable material is a solid, said solid may comprise solid tobacco or vape wax. The gel or solid to be vaporised may also comprise propylene glycol, glycerine or glycol derivatives and mixtures thereof.

The term "aerosol" may generally be understood to mean a solid or liquid particle suspended in a gas (for example, air), and the term "vapour" may generally be understood to mean a substance in the gas phase, which has for example transitioned from a liquid phase. However, references to an "aerosol" and to a "vapour" are general terms and they are not exclusive of the other. In particular, a vapour may be generated in close proximity to the target in addition to an aerosol.

In some cases, the vaporisable material may itself be the target, or the target may comprise the vaporisable material or may have in association therewith or in operative proximity thereto the vaporisable material.

In the case where the vaporisable material is a liquid, a wick may also be provided in the aerosol generating device for conveying a liquid to be vaporised from a reservoir for containing the liquid to the target in use. In some example, the target may be soaked in liquid before it is inserted into the aerosol generating device for use.

Especially in the case where the vaporisation material is a liquid and a wick is employed for conveying said liquid to the vaporisation site i.e. the target, the laser emitter source can be placed away from the vaporisation site by virtue of the light guide, and so the risk of leakage of liquid from the reservoir that splash on the lens or laser emitter is reduced.

The light guide is also preferably relatively thin in comparison to its length. For example, the width of light guide may be between 2 mm and its length may be 4 cm. In another example, the width to length ratio of the light guide may be between 1:5 to 1:100, more preferably between 1:10 to 1:50, yet more preferably 1:20. Hence, in examples where liquid vaporisable materials are used, should any splashes from liquid within the reservoir occur on the light guide, the area of such splashes is relatively small.

When present, the light guide may typically be placed very close to the target, and so in the case of liquid leakage from the reservoir resulting in splashes on the light guide, the scattering of laser light leaving the light guide is small, and so the resultant power density provided to the target is affected very little. Finally, the light guide being placed very close to the target means that splashes of any leaking liquid from the reservoir may be absorbed and contained within the target before it even reaches the light guide.

In examples of the present invention, the target may be a mesh structure, which may provide particularly good retention of liquid to be vaporised.

The target may comprise fibres or yarn. In particular, a mesh structure target that comprises fibres or yarn may be particularly advantageous for retaining liquid to be vaporised.

A material of the target may comprise Kevlar, ceramic and/or metal. In one example, the target is a mesh structure comprising Kevlar yarn. In another example, the target is a mesh structure comprising ceramic foam. In yet another example, the target is a mesh structure comprising a metal wire mesh.

In particularly preferred examples where the vaporisable material is a liquid, the target may comprise a first region and a second region, the first region having a lower density than the second region, whereby liquid is drawn from the first region to the second region via capillary action. One way in which this may be achieved is by having each of the first region and the second region comprising fibres or yarn of the same material, the fibres or yarn being thicker in the first region than the second region. Another way in which this may be achieved is by having the first region and the second region comprise fibres or yarn of different materials, wherein the material of the first region has a lower density than the material of the second region. In each of these configurations, the first and second regions of the target may merge at the wick, which may be made of the same material as the second region.

The provision of different densities between the first and second regions facilitates the drawing of liquid from the first region to the second region via capillary action. This way, the light guide of the aerosol generating device may be configured so as to direct light to the second region of the target where the concentration of liquid is higher, thus increasing efficiency of the device.

Further to improve efficiency, the laser emitter of the aerosol generating device may be configured to emit light in a wavelength spectrum matching the absorption peak of a surface material of the target, for example at 785 nanometres.

Preferably, the laser emitter may emit light in the infrared spectrum and the surface material of the target may have an absorption peak in the infrared spectrum. For example, the infrared spectrum may be between 700 and 1000 nanometres. If the material of the target is inherently more sensitive to light in say the UV wavelength spectrum, then a coating which is particularly sensitive to IR light may be applied to the target so as to shift the absorption peak of the target into the IR wavelength spectrum.

In an example where the target comprises mainly Kevlar fibres, and said Kevlar fibres are typically mainly absorbing of UV light, then a coating that is particularly sensitive to the IR light wavelength spectrum may be applied to the target so as to optimise the amount of IR light that is absorbed by Kevlar fibres and thus improve the efficiency of the vaporisation of liquid in the aerosol generating device.

The aerosol generating device may further comprise a reservoir for containing the vaporisable material, wherein the reservoir is removable from the aerosol generating device. In the case where the vaporisable material is a liquid, the reservoir preferably contains liquid to be vaporised, and the liquid to be vaporised may be drawn from the reservoir in use via a wick.

In addition to the reservoir, the aerosol generating device may further comprise a perforable member located between the reservoir and the target which prevents liquid communication between the reservoir and the target until said member is pierced in use. The perforable member, which may be a foil member, could be configured to be pierce-able by the wick itself, which may be pushed through the perforable member on order to allow liquid to flow toward to target. An advantage of using a perforable member is that liquid may be contained in the reservoir until the aerosol generating device is ready to be used by a user, thus keeping the liquid fresh until use.

In some example, two or more reservoirs may be employed (in a "split tank" reservoir configuration), each reservoir containing liquid to be vaporised, which may be the same liquid as one another or each different liquids. If the liquid is the same, then it may be preferable to use the split tank in conjunction with one or more perforable members so that a user is given more flexibility in selecting how many portions of liquid to release at any one time for example to adjust the strength of the aerosol produced. If the liquid in each reservoir is different, then the user can advantageously select which flavour or how many flavours of liquid to use at any one time according to his or her taste.

In cases where more than one reservoir is used, said reservoirs may be configured to snap-fit together to form a single unit. Prior to assembly of the two or more reservoirs in the snap-fit fashion, an airtight blister foil may be used in order to keep each of the reservoirs separate and also to prevent the perforable member being pierced accidentally if such a perforable member is provided.

Furthermore, in cases where more than one reservoir is used, one target may be provided for each reservoir. One laser and one light guide and optionally lens assembly may be used with each reservoir and each of these components may be in a fixed relationship with one another. Alternatively, a single laser and a light guide and optionally lens assembly may be used, in which case, at least the light guide and optionally lens assembly are movable, preferably rotatable, with respect to the targets so that different targets may be heated at different times.

Viewed from another aspect of the present invention, there is provided an aerosol generating system comprising the aerosol generating device as defined above, the system further comprising an outer shell for receiving the aerosol generating device, so that the aerosol generating device is at least partially contained within the outer shell.

In some examples of the arrangement of the components of the aerosol generating system, the aerosol generating device (comprising the target, the wick, the laser emitter and the light guide) may be configured to be at least partially insertable and removable from the outer shell.

In some examples of the arrangement of the components of the aerosol generating system, the laser emitter may be configured to be received and held within the outer shell, the reservoir may be configured to be received in abutment to the outer shell and the reservoir and the target may be configured to be removable from the outer shell.

The system may further comprise control electronics that permits activation of the laser emitter once the aerosol generating device is received by the outer shell. In some cases, control electronics may only permit activation of the laser emitter once the aerosol generating device is received by the outer shell and not if the aerosol generating device is absent of the outer shell. The control electronics act as a safety feature so that the laser emitter cannot emit light unless it is received by the outer shell and the other components are arranged in place relative to the laser emitter. The control electronics may be, for example, an optical or other proximity sensor to detect the presence of the aerosol generating device.

The shape of each of the reservoir and the target may be at least partially formed as a hollow cylinder, whereby the reservoir at least partially surrounds the target, and the reservoir and the outer shell are rotatable relative to one another, whereby relative rotation of the reservoir with respect to the outer shell causes relative rotation between the light guide and the target, which has the effect that the light emitted by the laser emitter is caused to hit the target at various portions around its circumference.

It will be appreciated that all of the features and advantages associated with the aerosol guiding device of the aerosol generating system as described above may equally apply in the aerosol generating system.

Viewed from another aspect of the present invention, there is provided a method of generating an aerosol with an aerosol generating device or aerosol generating system, the method comprising: generating laser light with a laser emitter; and directing the laser light to form an aerosol from a vaporisable material. In embodiments the method may involve guiding the laser light with a light guide.

The aerosol generating device used with this method may be a device configured to provide the aerosol through a mouthpiece to a user. The laser light may be guided to a target and/or vaporisation material. The vaporisable material may itself be the target, or the target may comprise the vaporisable material or may have in association therewith or in operative proximity thereto the vaporisable material.

Certain preferred embodiments of the present invention will now be described by way of example only with reference to the accompanying drawings, in which:

DETAILED DESCRIPTION

Before describing several exemplary embodiments of the invention, it is to be understood that the invention is not limited to the details of construction or process steps set forth in the following description. It will be apparent to those skilled in the art having the benefit of the present disclosure that the invention is capable of other embodiments and of being practiced or being carried out in various ways.

Figure 1A:
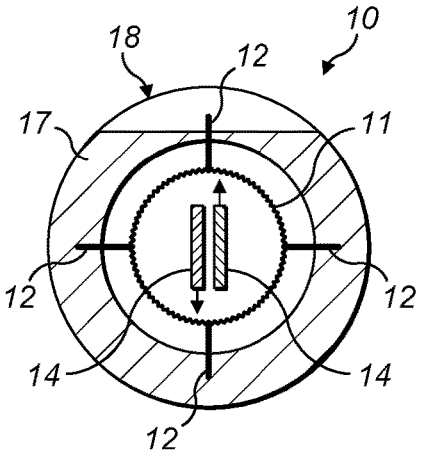
FIGS. 1A, 1B and 1C show an aerosol generating device in accordance with an example of the present invention from a front view, a side view and an exploded view respectively.
Figure 1B:
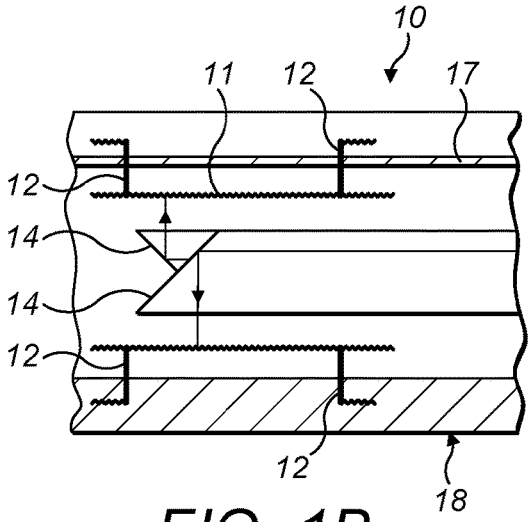
Figure 1C:
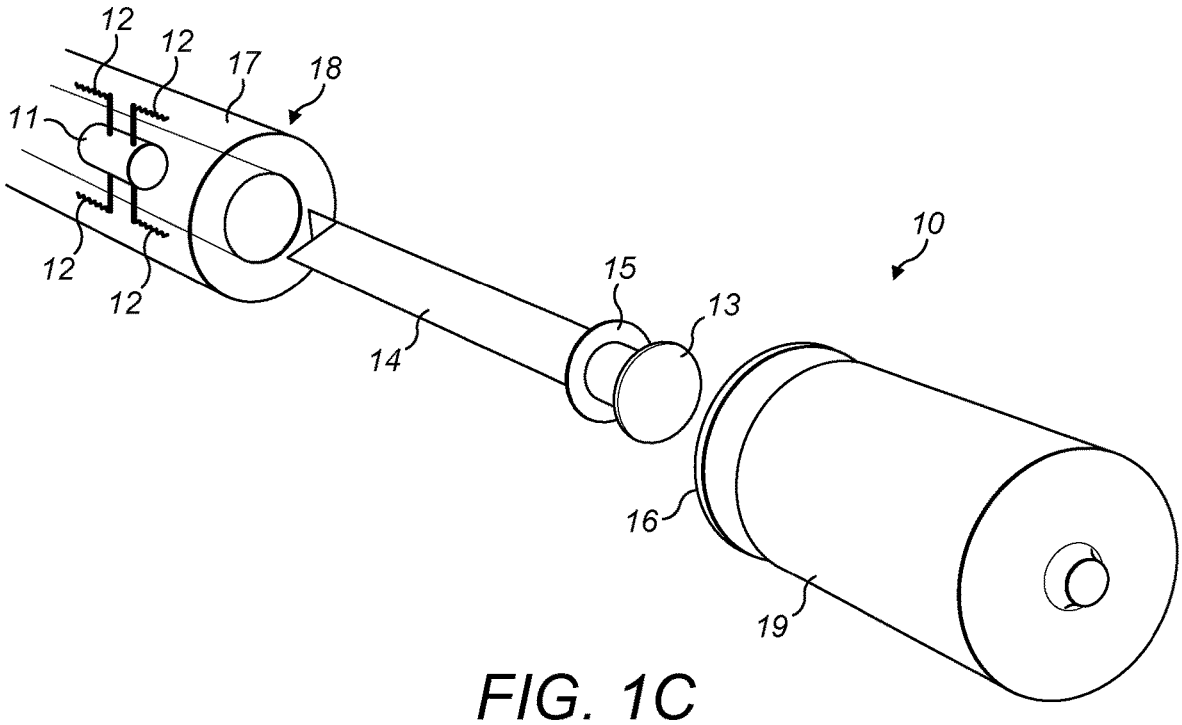

In FIGS. 1A, 1B and 10, an aerosol generating device 10 in accordance with an example of the present invention is shown from a front view, a side view and an exploded view respectively. In a basic configuration, the aerosol generating device 10 comprises a target 11, four wicks 12 for conveying a liquid 17 to be vaporised from a reservoir 18 for containing the liquid to be transported to the target 11 in use; a laser emitter 13 which may be in the form of a laser diode 13 configured to emit light and vaporise liquid 17 at the target 11 in use; and a light guide 14 for guiding light emitted from the laser emitter 13 to the target 11. The aerosol generating device 10 of FIGS. 1A, 1B and 10 further comprises the reservoir 18 that contains liquid 17, control electronics 16 and a battery 19.

In FIGS. 1A, 1B and 10, reservoir 18 is shown to be a hollow cylinder with liquid 17 contained therein, and target 11 is also shown to be a hollow cylinder that sits within the reservoir, the target 11 having four wicks 12 attached thereto and extending into the reservoir 18 such that it is in fluid communication with the liquid 17. Light guide 14 sits within the target 11 and it directs light that has been emitted by the laser emitter 13 towards the target 11. Although the example of FIGS. 1A, 1B and 10 shows four wicks 12, the present invention may equally be achieved using one or more wicks. In a further example not shown in the Figures, fluid may be conveyed to the target by alternate means, such as via capillary action of one or more conduits.

In FIG. 1A, it can be seen that the light guide 14 consists of two light bars that are adjacent one another, one light bar directing light upwards towards the target 11 and the other light bar directing light downwards towards the same target 11 (although a single light bar may also be used in another example not shown in the Figures). In FIG. 1B, it can be seen that the light bars are angled up to 45 degrees at the point at which light exits, which provides extremely accurate and controlled redirection of light. The laser emitter may emit light of wavelength of the IR spectrum (for example between 700 to 1000 nanometres, or more preferably, 785 nanometres). In FIG. 10, it is shown that the light emitted from the laser emitter 13 is firstly transmitted through a lens 15 that may adapt the emitted laser picture, which may be for example 1 micrometre×100 micrometres in size, to the final size, for example 0.1 millimetres×10 millimetres in size, before it reaches the light guide 14. In variants of the above example, the lens and/or the light guide 14 may be omitted.

The target 11 may comprise a mesh structure, for example a partially coated Kevlar yarn that is fed with liquid 17 from the reservoir 18 via wicks 12. Kevlar fibres are generally absorbent of ultraviolet light, and so the coating preferably comprises a material which mainly absorbs infrared light, in order to co-operate with the infrared light that is emitted by the laser emitter 13. In alternative examples not shown in the Figures, the mesh structure may be a ceramic foam or metal wire mesh.

Figure 2:
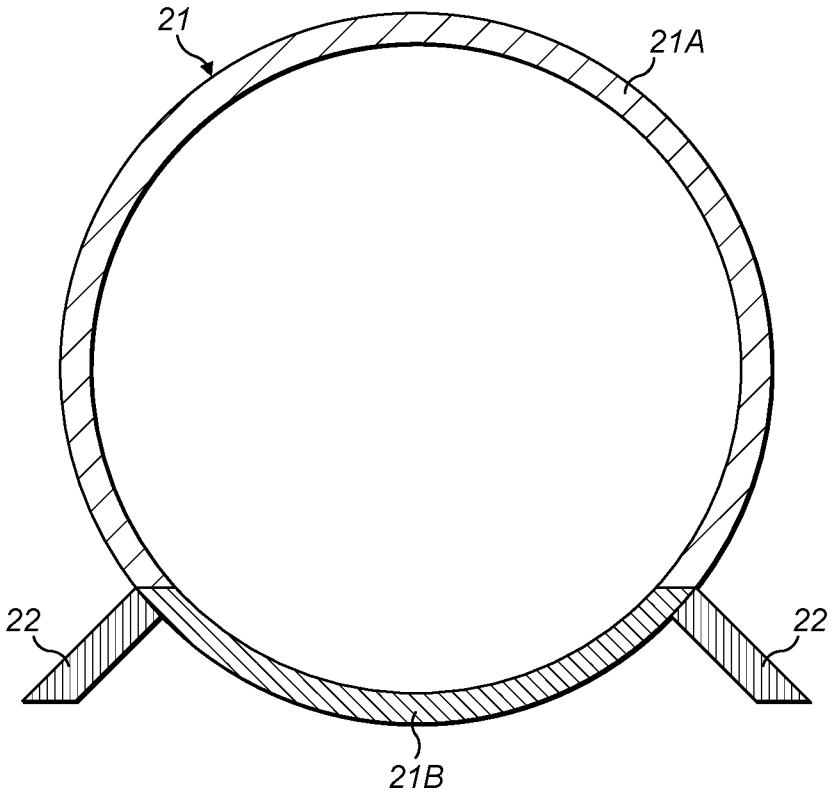
FIG. 2 shows a target and a wick for use in an aerosol generating devices in accordance with an example of the present invention from a front view.

In FIG. 2, an enlarged view of the target 21 of the aerosol generating device is shown. Target 21 is a target mesh that consists of two different areas having different yarn quality. The first region 21A comprises thicker fibres that are woven in a less dense manner than the second region 21B, which is woven in a denser manner with thinner fibres. This arrangement is chosen to provide a gradient in capillary forces between the first region 21A and the second region 21B such that a liquid is drawn from the first region 21A to the second region 21B via a capillary action. In this example, the two different yarn areas merge at the wick 22. Laser light from the laser emitter via the light guide may be preferably directed towards the thinner fibres of dense yarn where liquid is concentrated in order to maximise the amount of vaporisation that takes place.

Figure 3A:
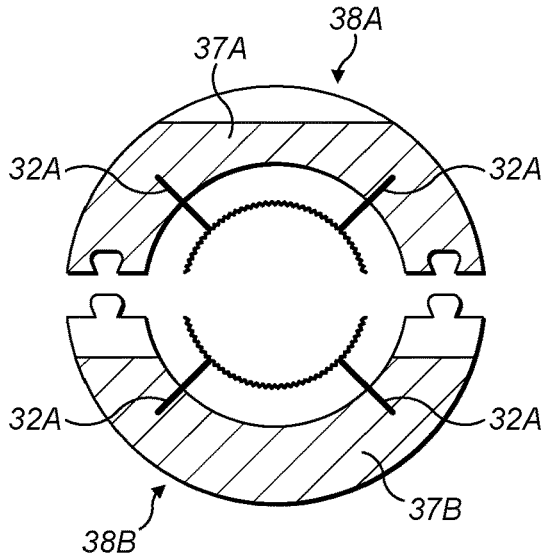
FIGS. 3A, 3B and 3C show a two part split-tank reservoir configuration, a part of said split-tank reservoir configuration from a front view and from a perspective view respectively.
Figure 3B:
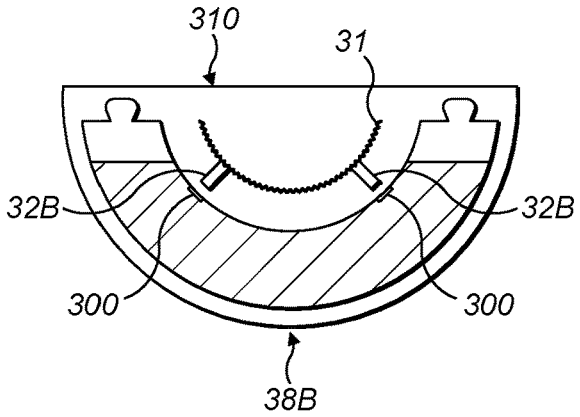
Figure 3C:
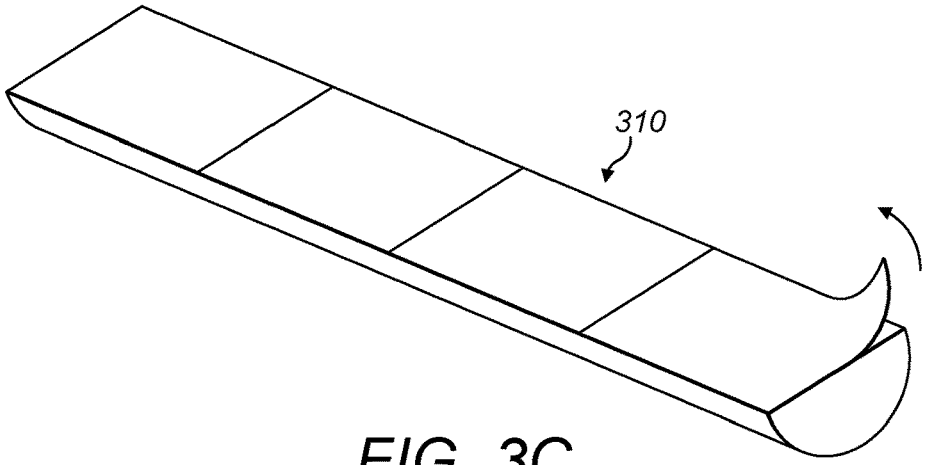

In FIGS. 3A, 3B and 3C, a split-tank configuration of reservoir and target is illustrated. Here, it is possible to have different flavours of liquid 37A, 37B held within reservoirs 38A, 38B. Thus, the user is provided with flexibility in choosing which flavour of liquid 37A, 37B to vaporise at any time during the smoking experience. The two reservoirs 38A, 38B may sit together via a connection arrangement, for example a snap-fit mechanism as illustrated, a force fit, friction fit or other suitable attachment. The reservoirs 38A, 38B may be supplied inserted and also removable from an exterior shell of an aerosol generating system. As such, such an aerosol generating system may be reusable, and reservoirs containing the same or different liquid may be replaced by the user as desired, for example, once all of the liquid contained therein has been vaporised or when they wish to smoke a different flavour of liquid.

Prior to use, a replaceable reservoir may be packaged in a blister pack 310 which is air tight and closed using a foil membrane, as shown in FIG. 3C, which may be peeled back by the user in order to access the reservoir. In some examples, the wick 32A is already arranged such that it extends into the reservoir 38A, 38B and so it is ready for use. However, in another example, such as that shown in FIG. 3B, the aerosol generating device further comprises perforable member 300 that is located between the reservoir 38B and the target 32A which prevents the liquid communication between the reservoir 38A and 38B and the target 31 until said perforable member 300 is pierced in use. In the example of FIG. 3B, after the user has peeled back the blister pack 310, he or she can then use for example the wick 32B in order to pierce the perforable member 300 in order to allow fluid communication between the reservoir 38B and the target 31 via the wick 32B.

Figure 4A:
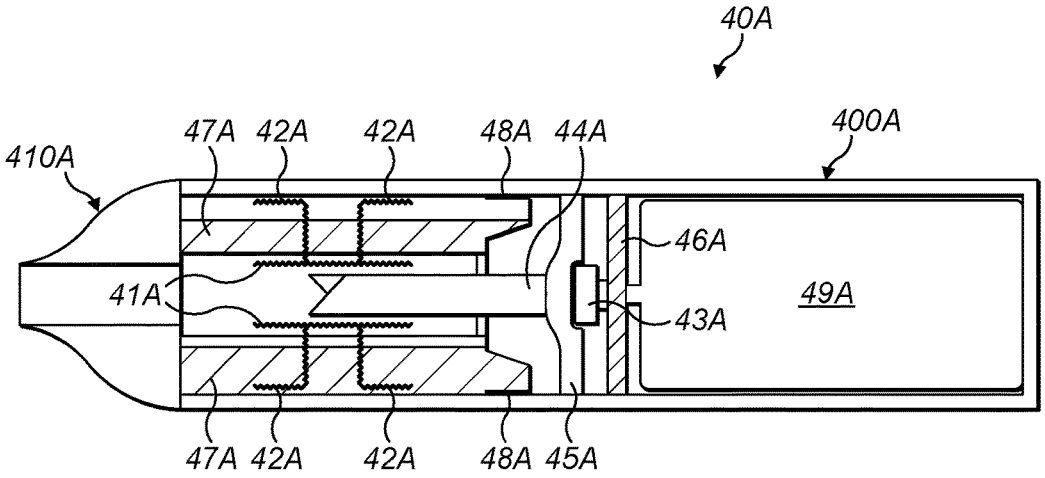
FIGS. 4A and 4B each show aerosol generating systems in accordance with examples of the present invention from a side view.
Figure 4B:
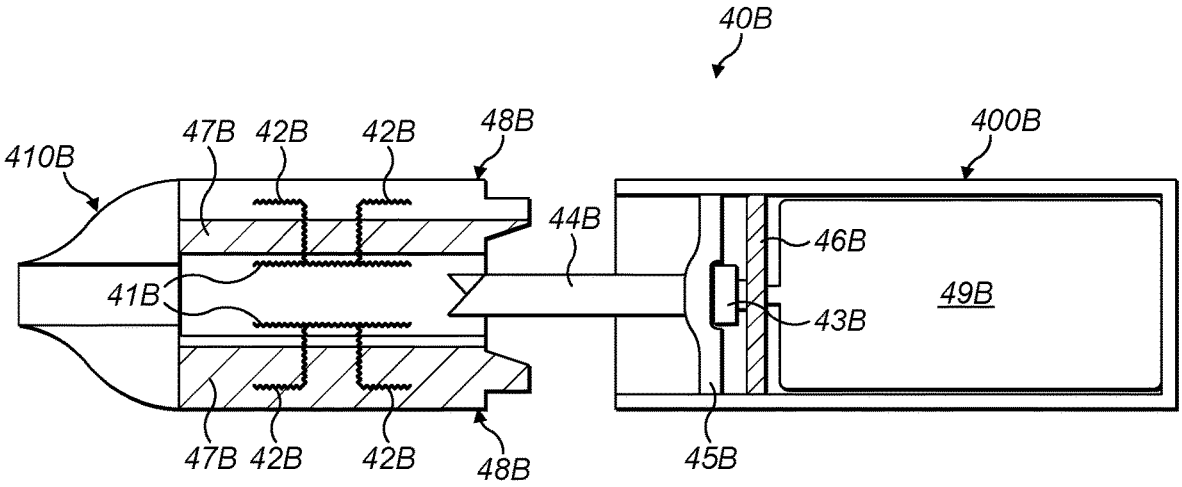

Now turning to FIGS. 4A and 4B, two different set ups of aerosol generating systems 40A, 40B are shown. In both cases, the aerosol generating system 40A, 40B comprises target 41A, 41B, wicks 42A, 42B, laser emitter 43A, 43B, light guide 44A, 44B, lens 45A, 45B, control electronics 46A, 46B, liquid 47A, 47B held within reservoir 48A, 48B, battery 49A, 49B, mouthpiece 410A, 410B and outer shell 400A, 400B.

A difference between the aerosol generating systems 40A, 40B of FIGS. 4A and 4B is that the outer shell 400A of aerosol generating system 40A is configured to hold the entire aerosol generating device therein, and aerosol generating system 40A is shown in a fully assembled state the outer shell 400A abuts mouthpiece 410A. In contrast, the outer shell 400B of aerosol generating system 40B abuts reservoir 48B and aerosol generating system 40B is shown in a partially inserted state in FIG. 4B. In this case, the battery 49B, the control electronics 46B, the laser emitter 43B and the light guides 44B are positioned within the outer shell 400B and mounted thereto. The reservoir 48B may fit into the outer shell 400B via a snap-fit mechanism. The reservoir 48B is situated at the front end of the aerosol generating system, which may be an electronic cigarette, on to which the mouthpiece 410B is mounted.

As shown in FIGS. 4A and 4B (but applicable in any of the examples of the Figures), the reservoir 48A, 48B may be made of a transparent material and so the remaining level of liquid 47A, 47B within the reservoir 48A, 48B may be seen by the user. This provides an indication to the user as to when the reservoir 48A, 48B should be replaced, or when the liquid 47A, 47B contained therein should be replenished. In each example, the reservoir 48A, 48B is easily exchangeable and suited for disposable use.

In the case where more than one reservoir 48A, 48B is provided, the direction of light exiting the light guide 44A, 44B may be changed by rotation of a light guide 44A, 44B, or rotation of the light guide 44A, 44B and lens 45A, 45B, or rotation of the entire light guide 44A, 44B, lens 45A, 45B and laser emitter 43A, 43B assembly. A single laser emitter 43A, 43B and light guide 44A, 44B assembly may therefore be used with a plurality of reservoirs 48A, 48B containing different liquids 47A, 47B, each having its own wick 42A, 42B and target 41A, 41B assembly, and rotation of the appropriate components by the user results in different wicks 42A, 42B that are associated with different reservoirs 48A, 48B being heated. Alternatively, a laser emitter 43A, 43B, lens 45A, 45B and light guide 44A, 44B assembly may be provided for each reservoir and target.

Further advantages of the system of any of the examples shown in the Figures include that the laser emitter 43A, 43B source is far away from the vaporisation site by virtue of the placement of the light guide 44A, 44B, and so the risk of leakage of liquid 47A, 47B from the reservoir 48A, 48B that splash on the lens 45A, 45B, laser emitter 43A, 43B or control electronics 46A, 46B is reduced.

The light guide 44A, 44B is relatively thin in comparison to its length, for example, the width of light guide may be 2 mm and its length may be 4 cm, and so should any splashes from liquids within the reservoir 48A, 48B occur on the light guide, the area of splashes is relatively small.

Furthermore, the light guide 44A, 44B is typically placed very close to the target 41A, 41B, and so in the case of liquid leakage from the reservoir 48A, 48B resulting in splashes on the light guide 44A, 44B, the scattering of laser light leaving the light guide 44A, 44B is small, and so the resultant power density provided to the target 41A, 41B is affected very little. Finally, the light guide 44A, 44B being placed very close to the target 41A, 41B means that splashes of any leaking liquid from the reservoir 48A, 48B may be absorbed and contained within the target 41A, 41B, which may be a highly absorbent mesh structure, before it even reaches the light guide 44A, 44B.

Although not shown in FIGS. 1A, 1B, 10, 2, 3A, 3B, 3C, 4A and 4B, another example of the present invention does not include the wick and the target is soaked in a vaporisable liquid material before it is inserted into the aerosol generating device for use.

Figure 5A:
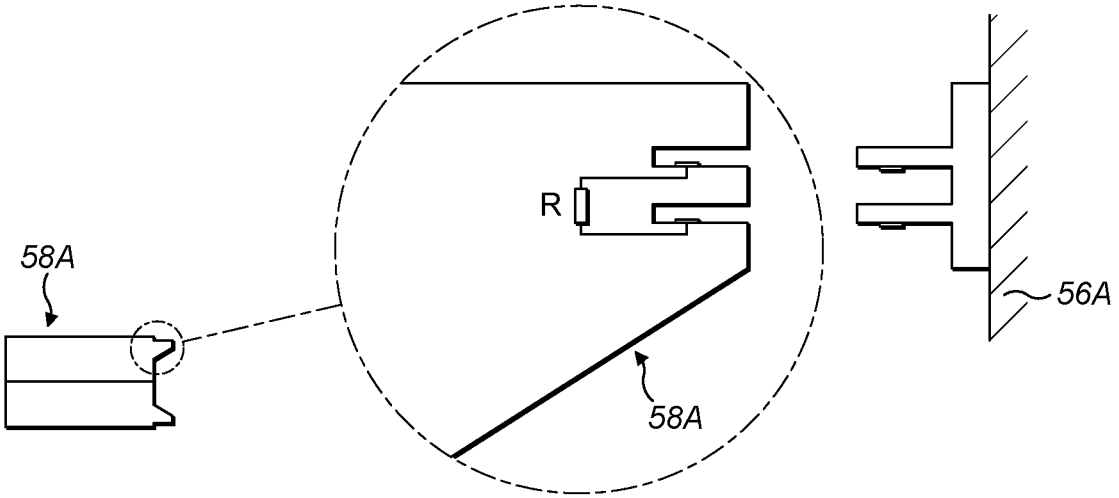
FIGS. 5A and 5B show safety features of the aerosol generating system in the form of control electronics in accordance with examples of the present invention from a side view.
Figure 5B:
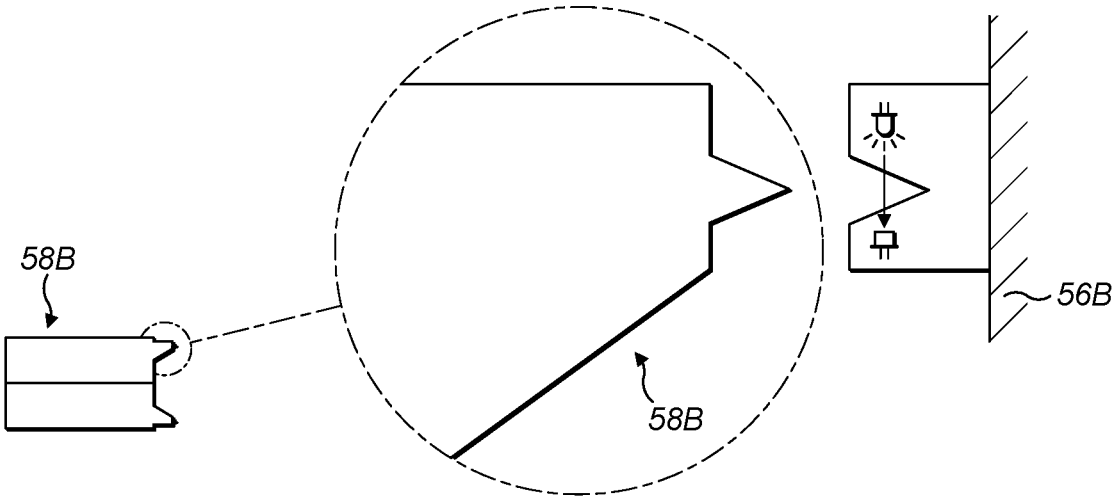

A number of safety features that may be included with the aerosol generating system of any one of the Figures are shown in FIGS. 5A and 5B. These ensure that unwanted laser beams, for example in cases where there is no reservoir containing a vaporisable material inserted in the aerosol generating system, are avoided. In FIG. 5A, an electrical safety circuit is closed when the reservoir is inserted into a receiving portion on the control electronics 56A. Only when the circuit is closed can the laser emitter be switched on. In addition to the safety function, different flavours of liquid contained within reservoir 58A may be identified by assigning different resistance values to different flavours of liquid.

Another safety feature that may be provided for the aerosol generating system is shown in FIG. 5B, where a light barrier needs to be interrupted or closed before the laser emitter can be switched on. The geometrical shape of the reservoir 58B is selected so that it sits precisely into the receiving portion of the control electronics 56B.

Figure 6A:
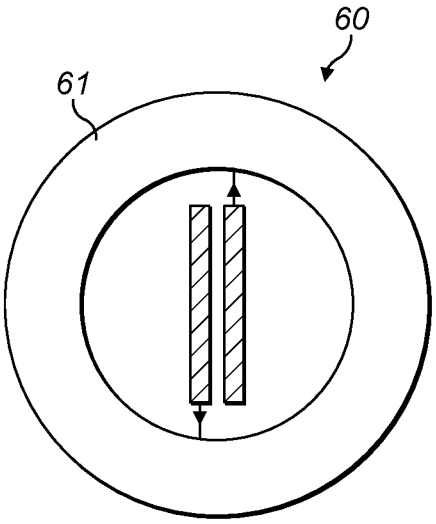
FIGS. 6A and 6B show an aerosol generating device in accordance with another example of the present invention from a front view and a side view respectively.
Figure 6B:
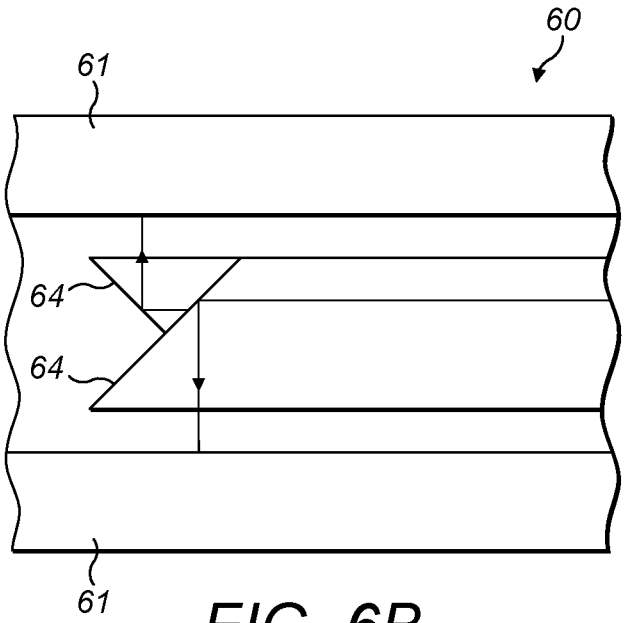

FIGS. 6A and 6B shows an example of an aerosol generating device 60 whereby the vaporisable material used therein is a solid or a gel, although the laser emitter is not shown; FIG. 6A represents a front view and FIG. 6B represents a side view.

The aerosol generating device 60 comprises a target 61, which is also the solid or gel vaporisable material in this case. A light guide 64 for guiding light emitted from the laser emitter (not shown in FIG. 6A or 6B) to the target 61 is also shown. When the light hits the target or vaporisable material 61, said material is vaporised into a gaseous state such that it is suitable for smoking.

In the claims, any reference signs placed between parentheses shall not be construed as limiting the claim. The word "comprising" does not exclude the presence of other elements or steps then those listed in a claim. Furthermore, the terms "a" or "an", as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an". The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

It will be appreciated that features described above in relation to one example of the present invention may also equally apply to any other example where appropriate.

The invention claimed is:

1. An aerosol generating device comprising:

a target at least partially formed as a hollow cylinder;

a reservoir at least partially formed as a hollow cylinder for containing vaporisable material; and a wick extending into the reservoir, wherein the wick is in fluid communication with the target, wherein the hollow cylinder of the reservoir at least partially surrounds and is substantially axially aligned with the hollow cylinder of the target, wherein the target is configured to receive a light guide within the target.

2. The aerosol generating device of claim 1, wherein the target comprises fibres or yarn.

3. The aerosol generating device of claim 1, wherein a material of the target comprises ceramic and/or metal.

4. The aerosol generating device of claim 1, wherein the target comprises a first region and a second region, the first region having a lower density than the second region, whereby liquid is drawn from the first region to the second region via capillary action.

5. The aerosol generating device of claim 4, wherein each of the first region and the second region comprise fibres or yarn of the same material, the fibres or yarn being thicker in the first region than the second region.

6. The aerosol generating device of claim 1, further comprising a perforable member located between the reservoir and the target which prevents liquid communication between the reservoir and the target until said member is pierced in use.

7. The aerosol generating device of claim 1, wherein the reservoir is mountable to an outer shell to form an aerosol generating system.

8. The aerosol generating device of claim 7, wherein the reservoir fits into the outer shell via a snap-fit mechanism.

9. The aerosol generating device of claim 1, wherein the reservoir is mountable to a mouthpiece.

10. The aerosol generating device of claim 4, wherein each of the first region and the second region comprise fibres or yarn of different materials.

* * * * *